US011219914B1

(12) United States Patent
Copp

(10) Patent No.: US 11,219,914 B1
(45) Date of Patent: Jan. 11, 2022

(54) CONSTRUCTION TOOL COVERING ACCESSORY

(71) Applicant: Mark Hutchinson Copp, Lake Worth, FL (US)

(72) Inventor: Mark Hutchinson Copp, Lake Worth, FL (US)

(73) Assignee: COPP & WRIGHT TOOL INNOVATIONS LLC, Lake Worth, FL (US)

( * ) Notice: Subject to any disclaimer, the term of this patent is extended or adjusted under 35 U.S.C. 154(b) by 277 days.

(21) Appl. No.: 16/273,325

(22) Filed: Feb. 12, 2019

Related U.S. Application Data

(60) Provisional application No. 62/629,159, filed on Feb. 12, 2018.

(51) Int. Cl.
*B05B 12/32* (2018.01)
*B05C 21/00* (2006.01)

(52) U.S. Cl.
CPC ..... *B05B 12/32* (2018.02); *B05C 21/005* (2013.01)

(58) Field of Classification Search
None
See application file for complete search history.

(56) References Cited

U.S. PATENT DOCUMENTS

| | | | | |
|---|---|---|---|---|
| 3,400,421 | A * | 9/1968 | Nappi | A47L 23/266 15/215 |
| 3,785,102 | A * | 1/1974 | Amos | A47L 23/266 15/215 |
| 4,107,811 | A * | 8/1978 | Imsande | A47L 23/266 15/104.002 |
| 2003/0135947 | A1* | 7/2003 | McKay | A47L 13/256 15/215 |
| 2004/0050324 | A1* | 3/2004 | Copp | B05B 12/28 118/504 |
| 2004/0145813 | A1* | 7/2004 | Wilson | A42B 3/26 359/630 |
| 2010/0236475 | A1* | 9/2010 | Bartusiak | B05B 12/24 118/505 |
| 2011/0094443 | A1* | 4/2011 | Karaga | B05C 21/005 118/504 |

* cited by examiner

*Primary Examiner* — Charles Capozzi
(74) *Attorney, Agent, or Firm* — John Rizvi; John Rizvi, P.A.—The Patent Professor®

(57) ABSTRACT

A convenient and labor-saving, chemically-resistant, multi-layered construction tool covering accessory is provided for protecting a paint shield or other flat-shaped construction tool from soiling during a construction process. The accessory includes a backing member comprising an adhesive inner side for adhering to a construction tool, and an opposed, outer side. At least one stack of removable cover sheets is affixed to the outer side of the backing member. Each removable cover sheet comprises an inner side, an outer side, and an adhesive material on the outer side of the removable cover sheet. The adhesive material is configured to detachably adhere to an adjacent cover sheet arranged over said each removable cover sheet, and to a wall or other surface when said each removable cover sheet is arranged in an outermost position of the at least one stack.

17 Claims, 8 Drawing Sheets

CONSTRUCTION TOOL COVERING ACCESSORY

CROSS-REFERENCE TO RELATED APPLICATIONS

This application claims the benefit of U.S. Provisional Patent Application Ser. No. 62/629,159, filed on Feb. 12, 2018, which is incorporated by reference herein in its entirety.

FIELD OF THE INVENTION

The present invention relates generally to construction tools (e.g., paint shields), and more particularly, to a chemically resistant, multi-layered construction tool covering accessory comprising a set of removable and disposable covers sheets configured to cover a construction tool and minimize build-up of paint, cement or other construction-related materials on the construction tool.

BACKGROUND OF THE INVENTION

It is important when painting areas with different and/or adjacent paint colors or patterns to prevent the differing paint applications applied to a first area from intruding or flowing into the adjacent or second area. Several tools have been developed to assist a painter in keeping the different painted areas separate. These tools include paint guides or shields which protect one area of a surface while painting an adjacent area of the surface. These paint shields typically include a flat plate or shield attached to a handle. In use, one side of the paint shield is positioned over the second area not to be painted with the leading edge of the paint shield along the junction of the first and second areas to be painted. The painter then applies paint on the first area. Thus, the shield covers and protects or "shields" the second area from the paint being applied to the first area. This produces a clean line of paint along the junction of the first and second painted areas.

Normally, as the paint is being applied, the painter endeavors to paint right up to the junction of the first and second areas to create a sharp paint line or junction. However, the paint often runs onto the leading edge of the shield and flows over onto the paint shield itself. Over time and with repeated applications of paint, the paint can build up on the shield, and especially the straight leading edge of the shield, to form a rough coating or inconsistent edge of paint on the shield. This buildup of paint then prevents the painter from obtaining a clean paint line as the painter applies the paint to the junction of the first and second areas thus requiring the painter to have to constantly stop painting and clean the paint shield before proceeding. This is a time consuming and messy procedure.

Some removable covers have been developed that can be applied to one side of a paint shield and peeled off as they load up with paint. However, these removable covers provide little or no protection to the leading edge of the paint shield itself resulting in the painter having to stop work to keep the leading edge of the paint shield clean of paint build up. Additionally, in the method used with these covers, the covers are only applied to one side of a paint shield requiring the painter to replenish the covers as he works and rendering the back or second side of the paint shield either useless or subject to the paint build up problem described above if he flips the shield over to use the second or back side of the shield.

Accordingly, there is an established need for a set or system of convenient and useful paint shield covers that can be removably applied to a paint shield to keep both sides and leading edge of the paint shield clean as the painter works over a large area to be painted and enabling the painter to continue working without having to stop to replenish the covers or clean the sides and leading edge of the paint shield.

SUMMARY OF THE INVENTION

The present invention is directed to a convenient and labor-saving construction tool covering accessory for protecting a paint shield or other construction tool from contamination from dripping paint, cement or other construction-related materials during a painting or other construction-related process. The construction tool covering accessory is a chemically resistant, multi-layered adhesive liner including an adhesive backing member which can be adhered to the construction tool. The construction tool covering accessory includes at least one stack of removable cover sheets positioned on an outer side of the backing member. The individual cover sheets forming the stack may include an outer, adhesive material to maintain them in a stacked condition during use, to adhere the stack to the wall or other surface to be painted, and to collect debris. The adhesive material is configured to allow a user to individually peel off each cover sheet in the stack after use.

In a first implementation of the invention, a construction tool covering accessory comprises a backing member having an inner side and an outer side opposed to the inner side, wherein the inner side comprises an adhesive material. The construction tool covering accessory further includes one or more stacks of removable cover sheets affixed to the outer side of the backing member. Each removable cover sheet has an inner side oriented towards the backing member and an outer side opposed to the inner side of each removable cover sheet. The outer side of each removable cover sheet is provided with an adhesive material. This adhesive material is configured to detachably adhere to an adjacent cover sheet arranged over and outward of each removable cover sheet and to remain on the outer side of each removable cover sheet when the adjacent cover sheet is peeled off. This adhesive material is further configured to detachably adhere to a wall or other surface when each removable cover sheet becomes arranged in an outermost position of the stack after having peeled off outer cover sheets after use.

In a second aspect, the one or more stacks of removable sheets can include a first stack of removable cover sheets affixed to a first portion of the backing member and a second stack of removable cover sheets affixed to a second portion of the backing member.

In another aspect, the backing portion can include an intermediate portion arranged between the first and second portions of the backing portion. The backing portion can be foldable along the intermediate portion.

In another aspect, the backing member can be foldable to a folded position in which the first and second stacks of removable cover sheets are arranged oppositely to one another. In the folded position, the first and second portions of the backing member are arranged facing one another and defining a slot therebetween, wherein the slot is configured to receive a flat-shaped construction tool.

In another aspect, in the folded position, a gap can be defined between the first and second stacks of removable cover sheets. The gap can be arranged along an intermediate portion of the backing member extending between the first and second portions of the backing member.

In yet another aspect, the intermediate portion can be central to the backing member.

In another aspect, the intermediate portion may be configured to wrap around and protect a leading edge of the flat-shaped construction tool.

In another aspect, the backing member can be arrangeable in a planar, extended position in which the first and second stacks of removable cover sheets are adjacent to one another. The gap may be formed only when the backing member is folded from the extended position to the folded position.

In another aspect, the first and second stacks of removable cover sheets can be adhered to the first and second portions of the backing member, respectively.

In yet another aspect, each stack of removable cover sheets may include an outer cover sheet, an inner cover sheet and a plurality of intermediate cover sheets stacked between the outer and inner cover sheets.

In another aspect, the adhesive material comprised in the outer side of each removable cover sheet can include a strip of adhesive material arranged at and along a top edge of each removable cover sheet.

In another aspect, the outer side of the backing member can include information and/or indicia, and the one or more stacks of removable cover sheets may be at least partially see-through such that the information and/or indicia on the outer side of the backing member is visible through the stacks.

In another aspect, the construction tool covering accessory can further include a peel-off layer removably attached to the adhesive material on the inner side of the backing member.

In yet another aspect, the inner side of each removable cover sheet may be non-adhesive.

In another aspect, the inner side of each removable cover sheet may be adhesive.

In another aspect, the outer side of the backing member can include a release coating configured to facilitate removal of an adjacent cover sheet of the stack of removable cover sheets.

In another aspect, the outer side of each removable cover sheet can include a release coating configured to facilitate removal of an adjacent cover sheet of the stack of removable cover sheets.

In yet another aspect, an edge area between each removable cover sheet and the adjacent cover sheet can be devoid of adhesive material to facilitate grasping the adjacent cover sheet to peel off the adjacent cover sheet from each removable cover sheet.

Introducing another embodiment of the invention, the present invention consists of a method of protecting a protective plate of a construction tool form dripping paint, comprising:

a providing a construction tool coveting accessory including a flexible backing member having an outer side and an inner side, the outer side including a first outer portion, a second outer portion and an intermediate portion extending from the first outer portion to the second outer portion, the first and second outer portions defining a gap therebetween, wherein the gap is arranged along the intermediate portion; the construction tool covering accessory further comprising a first stack of removable cover sheets affixed to the first outer portion; and a second stack of removable cover sheets affixed to the second outer portion;

bending the backing member about the intermediate portion to form a bend in the intermediate portion and define a slot between a first inner portion and a second inner portion of the inner side of the backing member; and inserting a protective plate of a construction tool into the slot defined between the first and second inner portions to cover at least a leading edge and a forward portion of the protective plate.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESERTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a convenient and economical construction tool covering accessory for covering and protecting a painter's paint shield from paint buildup during a painting process.

Figure 1:
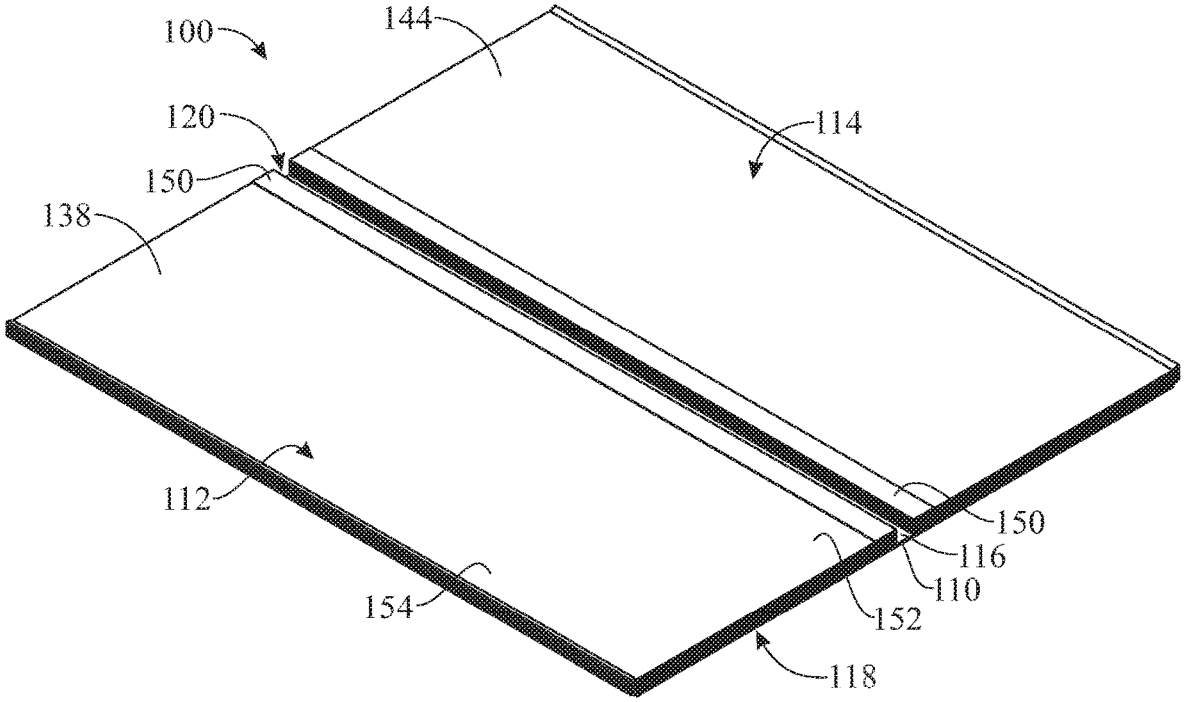
FIG. 1 presents a top front isometric view of a double-sided, construction tool covering accessory, shown in an expanded or open condition, in accordance with an illustrative embodiment of the present invention.

Referring initially to FIG. 1, a construction tool covering accessory 100 is illustrated in accordance with an exemplary embodiment of the present invention, configured as a disposable construction tool cover having a plurality of removable cover sheets. As shown, the construction tool covering accessory 100 generally includes a preferably flexible backing member 110, and at least one set or stack of removable cover sheets carried by the backing member 110 on a front side thereof. More specifically, the present embodiment comprises a first set or stack of removable cover sheets 112 and a second set or stack of removable cover sheets 114. The first and second stacks of removable cover sheets 112 and 114 are positioned on a front surface or outer side 116 of the backing member 110 while an opposite, rear surface or inner side 118 of the backing member 110 is configured to removably mount on a paint shield 300 (FIG. 6) or other flat-shaped construction tool as described in more detail hereinbelow.

Figure 2:
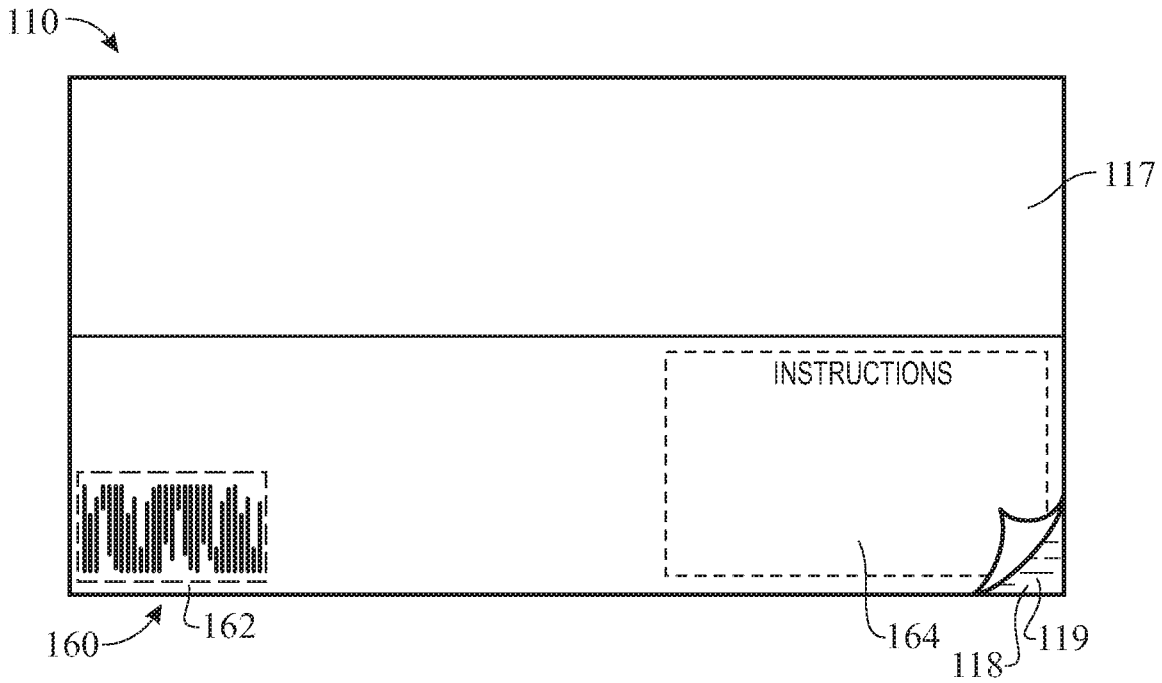
FIG. 2 presents a rear view of a backing member of the construction tool coveting accessory of FIG. 1 in the open condition.
Figure 3:
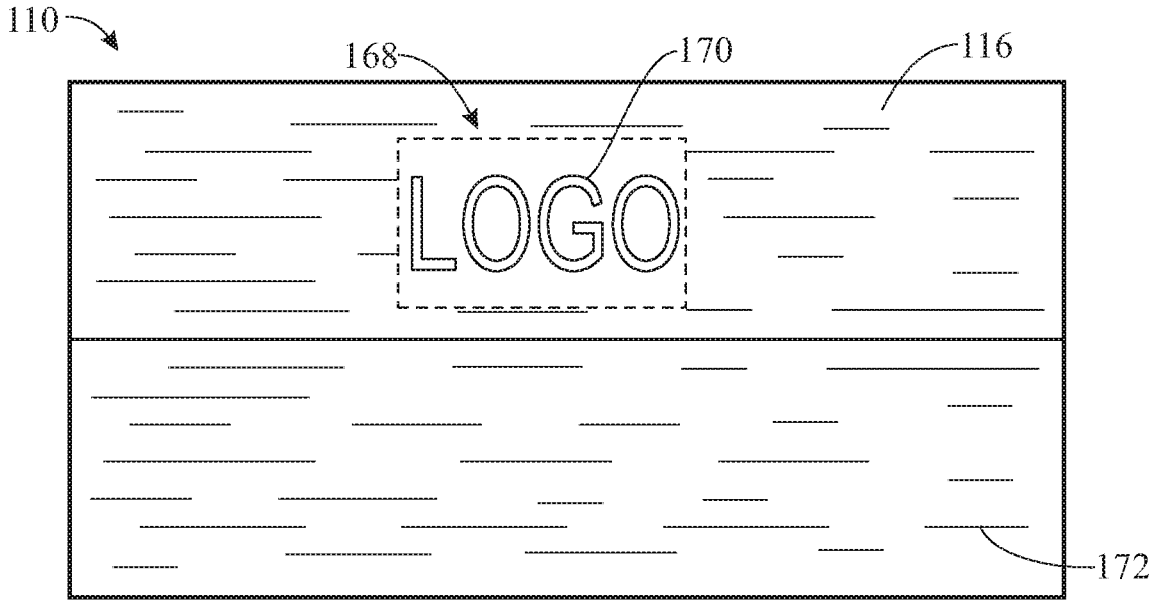
FIG. 3 presents a front view of the backing member of the construction tool covering accessory of FIG. 1 in the open condition.

The illustrations of FIGS. 2 and 3 show a rear view and a front view of the backing member 110, respectively, revealing further details of the backing member 110. As shown in FIG. 2, the rear surface or inner side 118 of the backing member 110 may be provided with an adhesive material 119 and may be initially covered by a peel-off sheet or layer 117 which is removed prior to attaching the construction tool covering accessory 100 to the construction tool. A visible side of the peel-off layer 117 may include various information and/or indicia 160 such as, but not limited to, a bar code 162, instructions for use or reordering 164, etc. In turn, as shown in FIG. 3, in some embodiments, the front surface or outer side 116 of the backing member 110 may be provided with information and/or indicia 168 such as, but not limited to, a logo 170, decoration, etc. Alternatively or additionally, the front surface or outer side 116 of the backing member 110 may include a release coating 172 to facilitate removal of an adjacent cover sheet of the stack of removable cover sheets after use, as will be described in more detail hereinafter.

Figure 5:
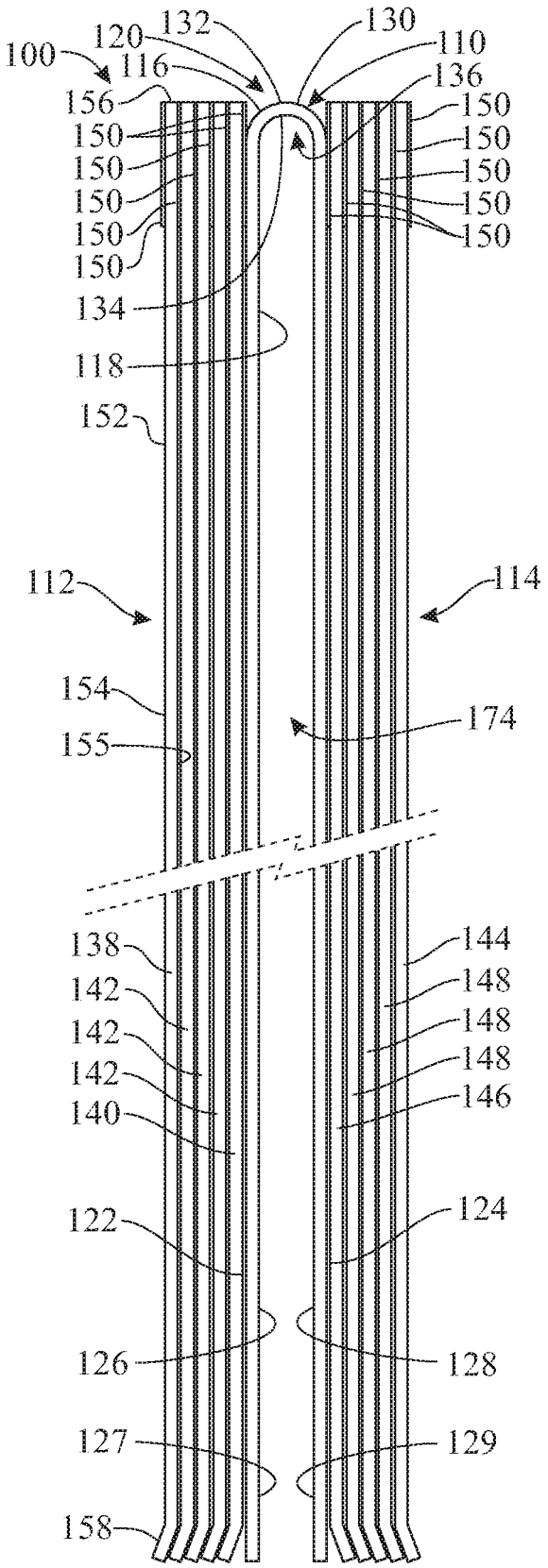
FIG. 5 presents a side elevation view of the construction tool covering accessory of FIG. 1 in the folded condition.

As further shown in FIG. 1, in some embodiments, the first and second stacks of removable cover sheets 112 and 114 can be spaced apart on the backing member 110 by a gap 120 defined between the first and second stacks of removable cover sheets 112 and 114. Furthermore, as shown in FIG. 5, the first stack of removable cover sheets 112 is positioned on a first portion of the backing member 110, wherein the first portion is delimited by, or comprises, a first outer portion 122 of the outer side 116 of the backing member 110 and a first inner portion 126 of the inner side 118 of the backing member 110 corresponding to and arranged oppositely, to the first outer portion 122. Similarly, the second stack of removable cover sheets 114 is positioned on a second portion of the backing member 110, wherein the second portion is delimited by, or comprises, a second outer portion 124 of the outer side 116 of the backing member 110 and a second inner portion 128 of the inner side 118 of the backing member 110 corresponding to and arranged oppositely to the second outer portion 124. The first inner portion 126 and second inner portion 128 comprise a respective edge or end portion 127 and 129. An intermediate portion 130 of the backing member 110 is located at the gap 120 and between the first outer and inner portions 122 and 126 and the second outer and inner portions 124 and 128 of the backing member 110. The intermediate portion 130 also includes an outer side 132 and an inner side 134 which together, when folded for use with the paint shield 300, form a bend 136 in the backing member 110 located at the gap 120. The intermediate portion 130 of the backing member 110 covers and protects a leading edge of the paint shield 300 from paint build up.

It must be noted that alternative embodiments are contemplated in which there is no gap 120 when the construction tool covering accessory 100 is in the flat position of FIG. 1. Instead, the first and second stacks of removable cover sheets 112 and 114 are adjacent to one another when the construction tool covering accessory 100 is in the flat position, and the gap 120 is only formed when the construction tool covering accessory 100 is folded to the position of FIG. 3.

As best shown in FIG. 5, the first stack of removable cover sheets 112 includes a plurality of peel-off sheets including a top cover sheet 138, a bottom cover sheet 140 and a plurality of intermediate cover sheets 142. Likewise, the second stack of removable cover sheets 114 includes a plurality of peel-off sheets including a top cover sheet 144, a bottom cover sheet 146 and a plurality of intermediate cover sheets 148. These cover sheets 138, 140, 142, 144, 146 and 148 may be formed from a variety of materials including natural papers, synthetic materials, etc. Additionally, the materials may include a wax base or release coating to prevent the sheets from firmly sticking to themselves or the surface being painted. Further, the disclosed cover sheets may include static or anti-static coatings.

In some embodiments, the removable cover sheets 138, 142, 140 forming the first stack of removable cover sheets 112 can be at least partially transparent or see-through, and can visibly reveal the outer side 116 of the backing member 110, such as to show the indicia 168 (e.g., logo 170) provided on the outer side 116 of the backing member 110. Alternatively or additionally, the removable cover sheets 144, 148, 146 forming the second stack of removable cover sheets 114 can be at least partially transparent or see-through, for identical purposes.

Except as otherwise described herein, the cover sheets in the first and second stacks of removable cover sheets 112 and 114, respectively, are substantially identical to each other in construction. The following detailed discussion of the cover sheets will be made with regard to a single cover sheet, for example the top cover sheet 138 of the first stack of removable cover sheets 112.

Figure 4:
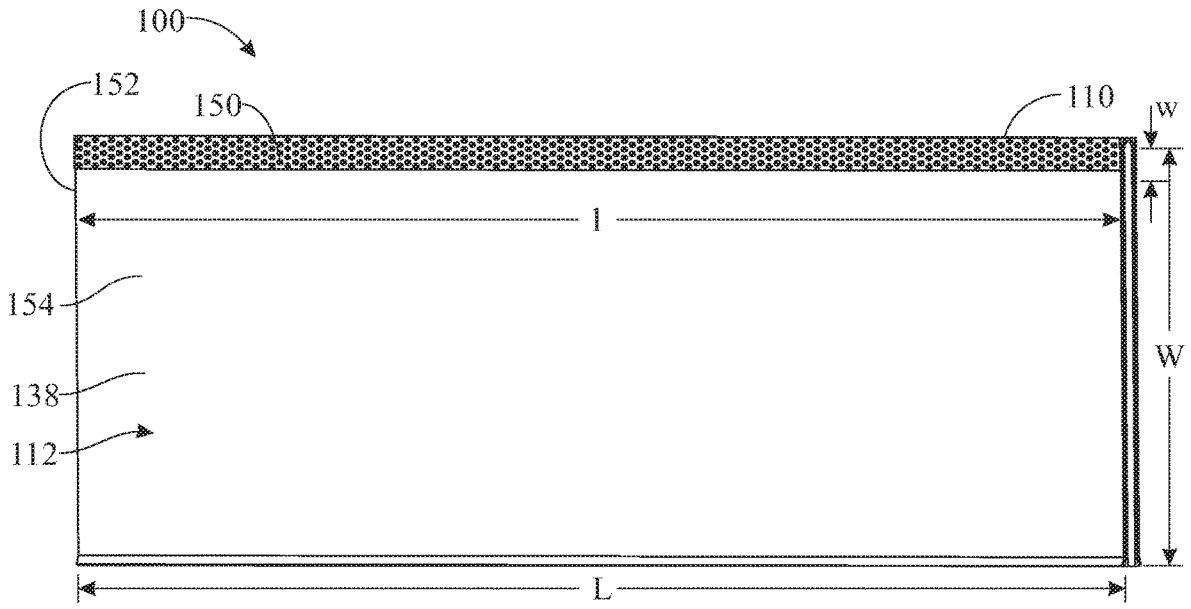
FIG. 4 presents a front perspective view of the construction tool covering accessory of FIG. 1, shown in a folded condition.

As shown in FIG. 4, the top cover sheet 138 can be generally rectangular having a length L and a width W. As shown in FIG. 5, the top cover sheet 138 has an outer or first side 154 and an opposed, inner or second side 155. On the outer or first side 154, the top cover sheet 138 is provided with an adhesive material configured to slightly and detachably adhere to the surface being painted. The adhesive material covers the outer or first side 154 at least partially (i.e. partially or entirely). In some embodiments, such as the present embodiment, the adhesive material covers the outer or first side 154 only partially, and is arranged at a top of the outer or first side 154. For instance, in the present embodiment, the top cover sheet 138 is provided with a thin adhesive strip 150 along a top outer edge 152 of an outer or first side 154 of the top cover sheet 138. As shown in FIG. 4, the adhesive strip 150 has a length l substantially equal to the length L of the top cover sheet and a width w substantially less than the width W of the top cover sheet 138 so as to allow only the top outer edge 152 of the top cover sheet 138 to adhere to a surface as it is being painted ad also prevent paint from passing towards the remainder of the outer or first side 154 of the top cover sheet 138 for purposes that will be hereinafter described. In different embodiments of the invention, the adhesive strip 150 can be adjusted either by length or width. In some embodiments, the remainder of the outer or first side 154 of the top cover sheet 138 (other than the thin adhesive strip 150) can be non-adhesive, and may optionally be provided with an outer coating or finish which helps prevent an adjacent sheet from sticking thereto and facilitate removal of said adjacent sheet after use. In other embodiments, in addition to the top adhesive strip 150, the outer or first side 154 may be provided with additional adhesive areas such as one or two lateral strips on opposite vertical edges of the outer or first side 154. It must be again noted that these features apply to all cover sheets comprised in the stacks, as mentioned heretofore.

It should be noted that, while the present discussion is with regard to the top cover sheet 138, all the remaining sheets in both the first and second stack of removable cover sheets 112 and 114 also contain an adhesive strip 150 along top edges thereof, as best shown in FIG. 5. This allows each sheet to temporarily stick or adhere to each other while in the stack configuration prior to being used and subsequently removed from the construction tool covering accessory 100. For example, the top cover sheet 138 is removably maintained within the stack configuration by the adhesive strip 150 on the underlying intermediate cover sheet 142. The other intermediate cover sheets 142 are removably maintained in the stack configuration by the adhesive strips 150 on the other underlying intermediate cover sheets 142 and the last or lowest in the stack intermediate cover sheet 142 is maintained in the stack configuration and onto the outer side 116 of the backing member 110 by adhesive strip 150 on the bottom cover sheet 140. Furthermore, as shown, an adhesive strip 150 or coating may also be provided between the rear of the bottom cover sheet 140 and the first outer portion 122 of the backing member 110 to removably maintain the bottom cover sheet 140, and thus the entire first stack of removable cover sheets 112, on the backing member 110.

Figure 9:
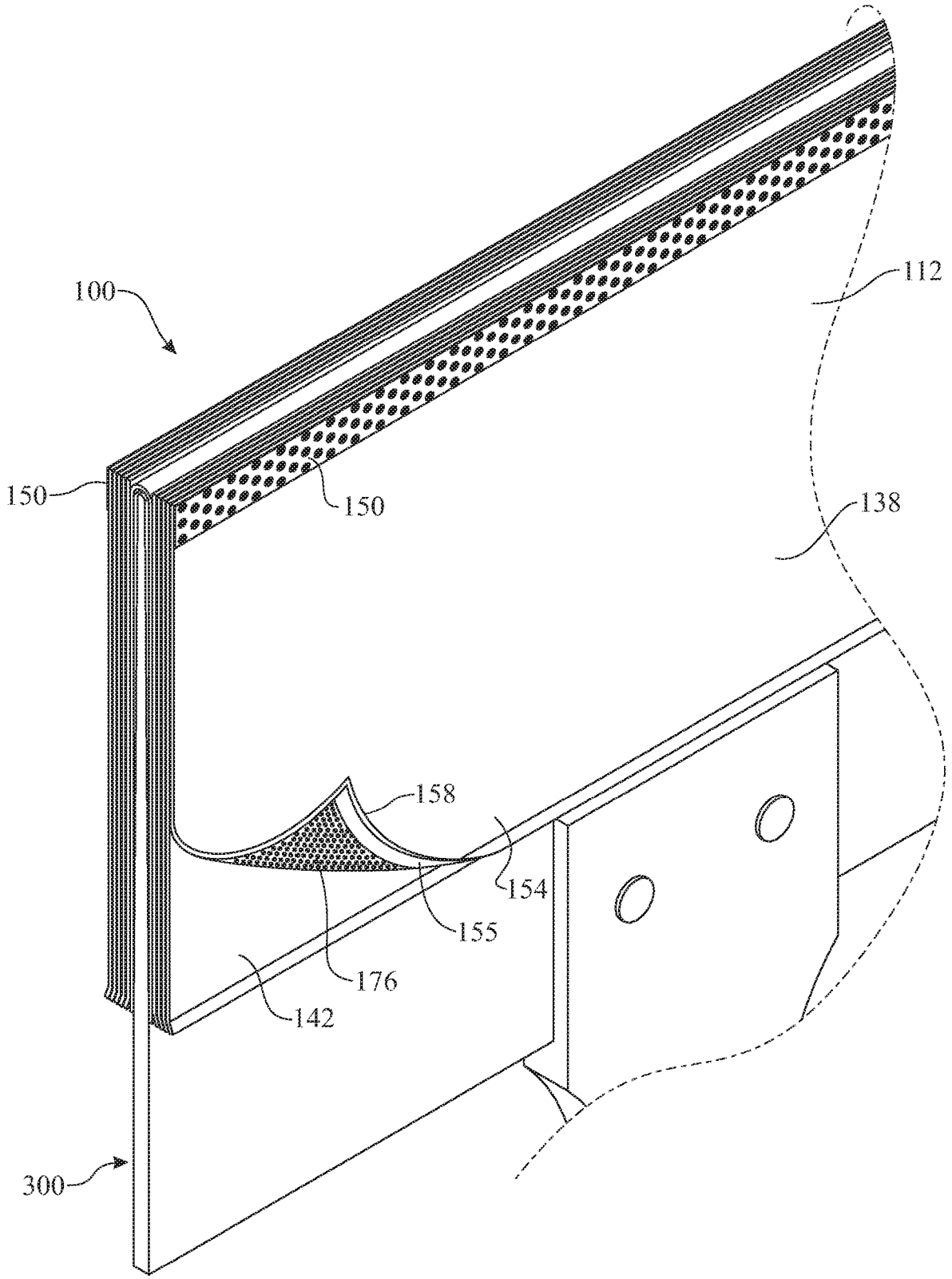
FIG. 9 presents an enlarged area of detail view of the paint shield and construction tool covering accessory of FIG. 1 as a top sheet of the stack of sheets of the construction tool covering accessory is being removed.

In some embodiments, the inner or second side 155 of the top cover sheet 138, shown in FIG. 5, can be provided with a second side adhesive material which further adheres the inner or second side 155 of the top cover sheet 138 to the adjacent, intermediate cover sheet 142. For example, as shown in FIG. 9, in some embodiments, the inner or second side 155 of the top cover sheet 138 may include a slightly adhesive coating 176 to allow the top cover sheet 138 to slightly adhere to the underlying intermediate cover sheet 142 and prevent the top cover sheet 138 from flapping or waving away from the first stack of cover sheets 112 during painting. Preferably, the adhesive coating 176 does not cover the inner or second side 155 of the top cover sheet 138 in its entirety; instead, it is preferred that one or more of the lateral or bottom edges of the inner or second side 155 is devoid of an adhesive coating, to facilitate gripping the second end 158 in order to peel the top cover sheet 138 off the first stack of cover sheets 112 as it becomes loaded up with paint and to reveal the clean intermediate cover sheet 142 below for continued use. For instance, in the present embodiment, the inner or second side 155 of the top cover sheet 138 is non-adhesive at a second end 158 of the top cover sheet 138, i.e. at an edge of the top cover sheet 138 opposite to the adhesive strip 150. It should be noted that these features apply to all cover sheets comprised in the stacks, as mentioned heretofore.

When the top cover sheet 138 of the present embodiment is removed from the adjacent, intermediate cover sheet 142, the second side adhesive material (adhesive material 176) remains on the inner or second side 155 of the top cover sheet 138, while the adhesive strip 150 remains on the outer or first side of the adjacent, intermediate cover sheet 142. In other words, as cover sheets are individually removed from the stack, an adhesive strip 150 stays on the remaining, outermost cover sheet and is oriented outwardly at a top of the stack in order to adhere to the wall or other surface to be painted.

With reference to FIG. 5, the top cover sheet 138 of the first stack of cover sheets 112, and all the remaining cover sheets 142, 140 in the first stack of removable cover sheets 112, have a top end or leading edge 156 adjacent the gap 120 or the bend 136 in the intermediate portion 130 of the backing member 110. The leading edge 156 of the top cover sheet 138 can be precisely positioned against the desired paint line to obtain a sharp paint line as described in more detail hereinbelow.

Figure 6:
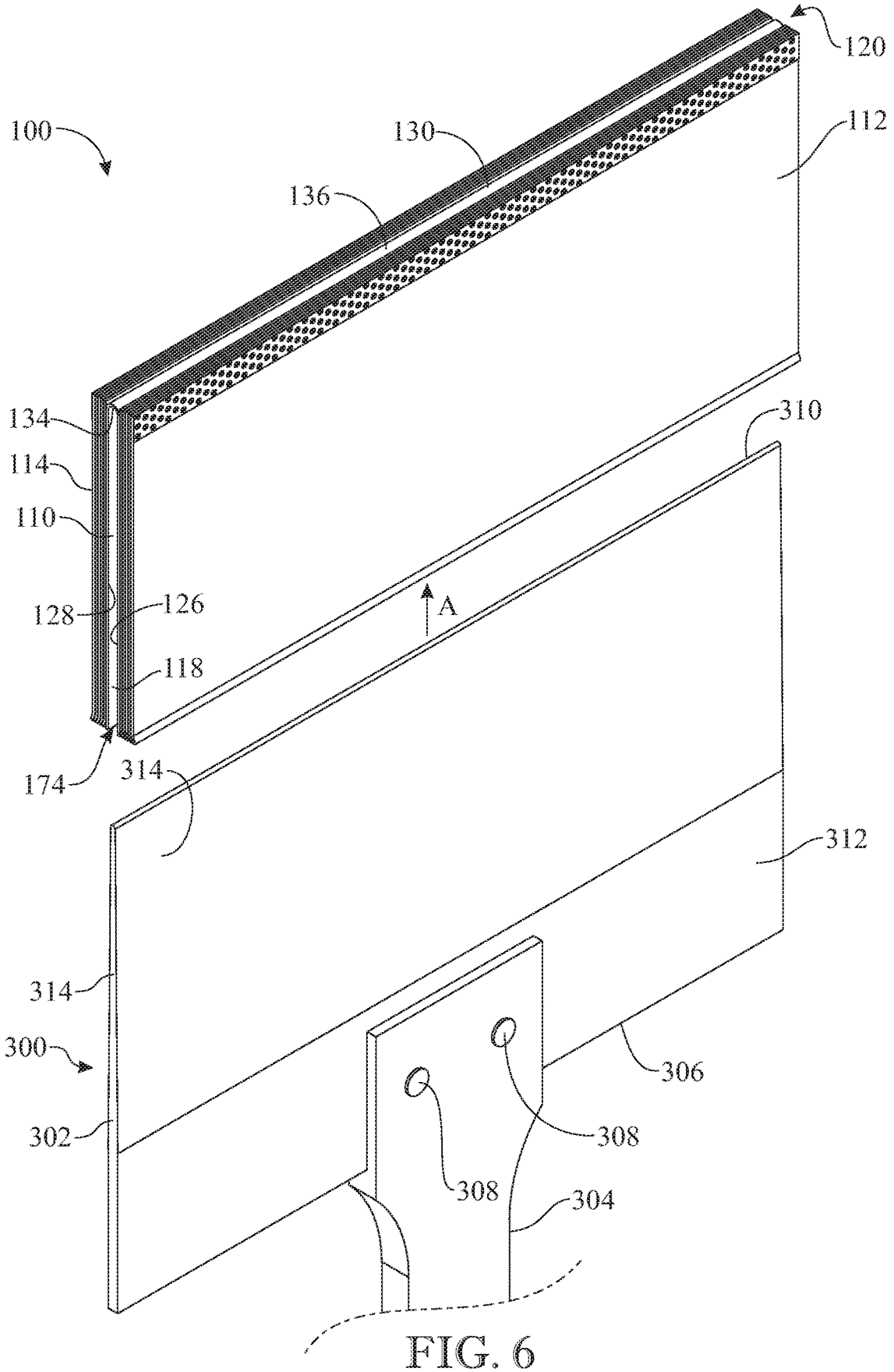
FIG. 6 presents an isometric view of the construction tool covering accessory of FIG. 1 being applied to a paint shield.
Figure 7:
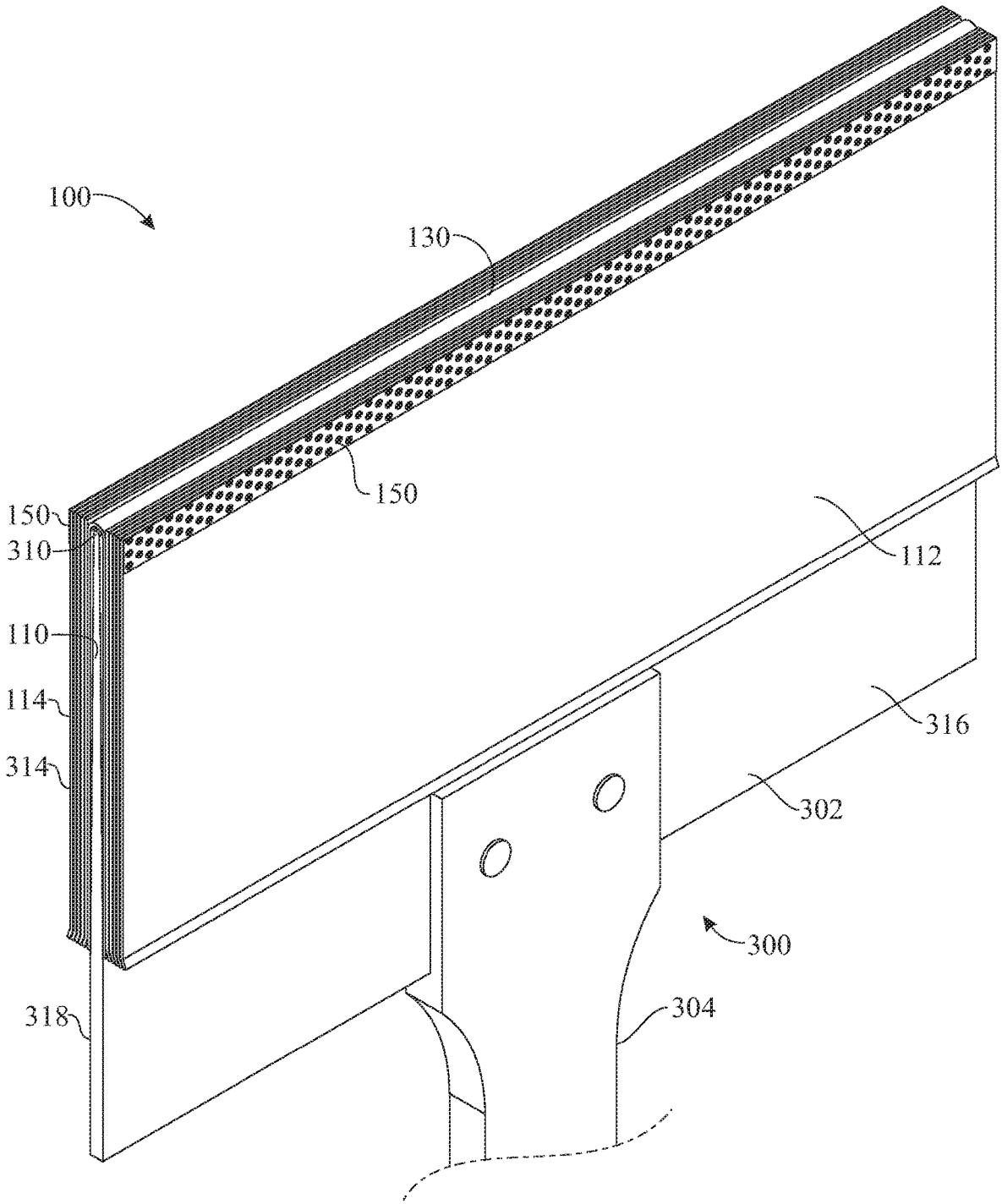
FIG. 7 presents an isometric view, similar to FIG. 6, with the construction tool covering accessory of FIG. 1 fully applied to the paint shield.
Figure 8:
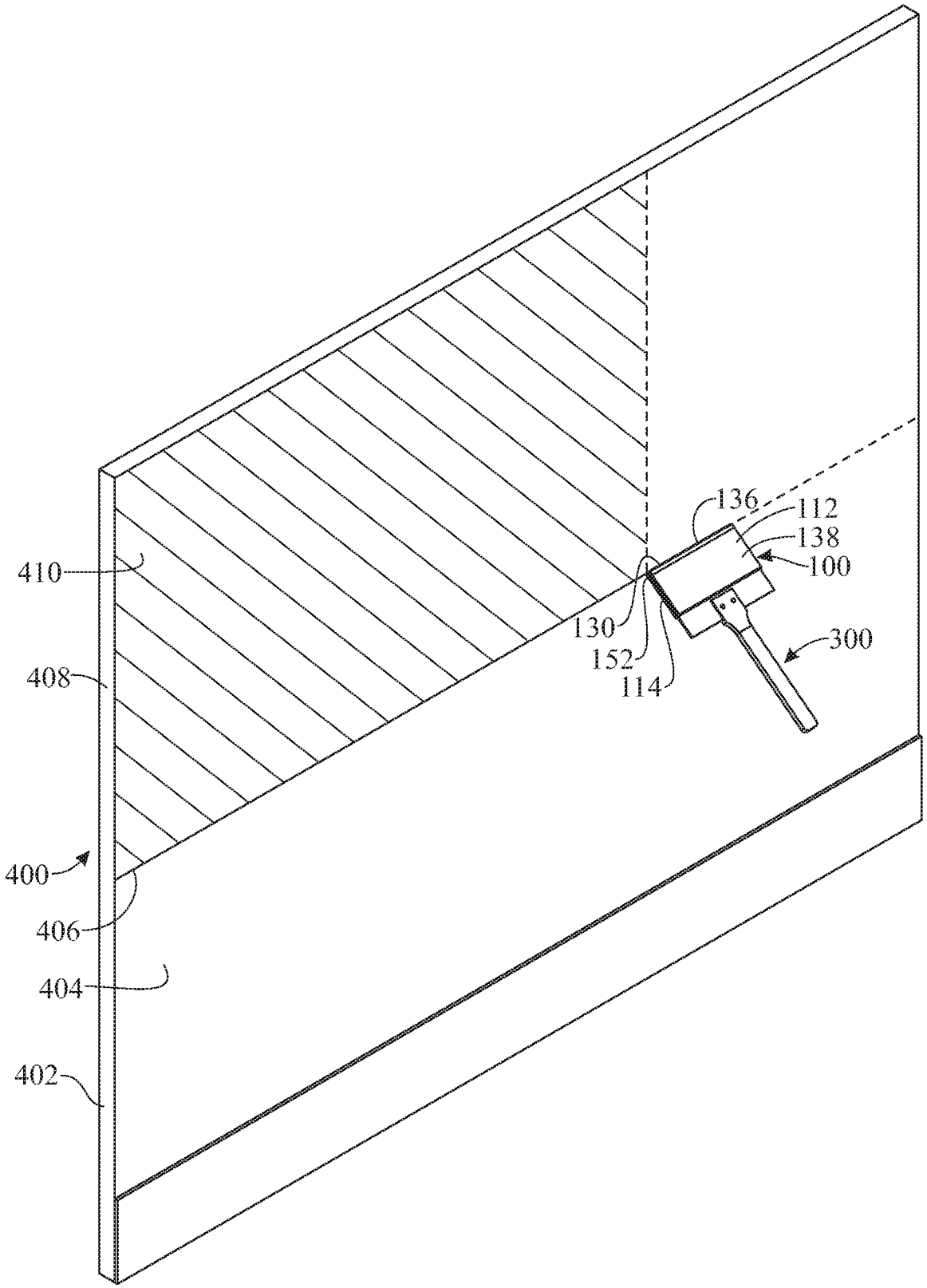
FIG. 8 presents an isometric view of the paint shield and the construction tool covering accessory of FIG. 1 in use to shield a second area of a wall as a first area of a wall is being painted.

Turning now to FIGS. 6-8, the use of the construction tool covering accessory 100 for covering a paint shield 300 will now be described. Referring initially to FIG. 6, the paint shield 300 generally includes a rectangular, flat protective plate 302 for protecting or shielding an underlying surface during painting and a handle 304 affixed to the protective plate for manipulating the protective plate 302. The handle 304 can be affixed to a rear edge 306 of the protective plate 302 by various means, such as, for example rivets 308. The protective plate 302 includes a generally straight and relatively sharp forward or leading edge 310 which is used to maintain a sharp and straight paint line on the surface to be painted. In the absence of the invention, should the leading edge 310 get loaded up with paint, the resulting paint lines will be rough and uneven and the paint shield 300 will need to be cleaned. Preferably, the protective plate 302 includes a strong rear portion 312 and a slightly tapered forward portion 314 containing the leading edge 310.

In order to assemble the construction tool covering accessory 100 to the paint shield 300, the peel-off layer 117 (FIG. 4) is removed from the rear surface or inner side 118 of the backing member 110 of the initially-flat construction tool covering accessory 100 (FIG. 1) and the construction tool covering accessory 100 is folded over to adopt the U-shaped configuration shown in FIGS. 3 and 6 and create the bend 136 in the intermediate portion 130 of the backing member 110. In some embodiments, the backing member 110 may be plastically deformable so that it does not tend to recover the initial flat shape of FIG. 1. Upon folding the construction tool covering accessory 100, a slot 174 for receipt of the paint shield 300 is created or defined between the first and second inner portions 126 and 128 of the inner side 118 of the backing member 110. Once the slot 174 has been created, the protective plate 302, and in particular the tapered forward portion 314 of the protective plate 302 can be inserted in the direction of arrow "A" into the slot 174 in the backing member 110. The tapered forward portion 314 of the protective plate 302 is inserted into the slot 174 until the leading edge 310 of the protective plate 302 abuts or is close to the inner side 134 of the intermediate portion 130 of the backing member 110. Alternatively, the construction tool covering accessory 100 can be directly folded over and onto the protective plate 302 of the paint shield 300. The adhesive material 119 of the rear surface or inner side 118 of the backing member 110 adheres the construction tool covering accessory 100 to the protective plate 302.

The assembled paint shield 300 and construction tool covering accessory 100 is illustrated in FIG. 7. The first stack of removable cover sheets 112 is presented on a first side 316 of the protective plate 302 and the second stack of removable cover sheets 114 is presented on a second side 318 of the protective plate 320. The leading edge 310 of the protective plate 302 of the paint shield 300 is shielded from paint by the intermediate portion 130 of the backing member 110 of the construction tool covering accessory 100.

Referring now to FIG. 8, in use, the assembled paint shield 300 and construction tool covering accessory 100 are used to assist a painter in painting one color on a surface such as, but not limited to, a wall 400 while preventing the one color from contaminating another color. For example, the wall 400 can include a first portion 402 which has been previously painted with a first pattern or color 404 having a top straight paint edge 406. In order to paint a second portion 408 of the wall with a second color 410 without contaminating the first color 404, the intermediate portion 130 of the backing member 110 of the construction tool covering accessory 100 is positioned such that the top outer edge 152 of the top cover sheet 144 of the second stack of removable cover sheets 114 lies flush with the top straight paint edge 406. The adhesive strip 150 can lightly adhere to the top straight paint edge 406 to maintain the assembled paint shield 300 and construction tool covering accessory 100 in position during painting and to block paint from passing beyond the top outer edge 152 and contaminating the first color 404 on the first portion 402 (between the wall 400 and the paint shield 300).

Once positioned, the painter can paint the second color 410 onto the second portion 408 of the wall 400 without risk of dripping paint onto the first portion 402 of the wall 400. Any dripping paint will be deposited on the top cover sheet 138 of the first stack of removable cover sheets 112 and not on the first side 316 of the protective plate 302 of the paint shield 300. Additionally, and importantly, the bend 136 in the intermediate portion 130 protects the sharp front or leading edge 310 of the paint shield 300 from accumulating paint thereby keeping it clean as well. In this manner, the construction tool covering accessory 100 allows a painter to maintain clean and even borders or delineations between differing paint colors or schemes while keeping the paint shield 300 clean.

Turning now to FIG. 9, as the painter continues to paint, the top cover sheet 138 of the first stack of removable cover sheets 112 may become loaded up with paint prior to completion of the painting. In this instance, the flared second end 158 of the top cover sheet 138 may be grasped and the now contaminated top cover sheet 138 peeled off and away from the underlying intermediate cover sheet 142. Specifically, the top cover sheet 138 is peeled away from the adhesive strip 150 on the underlying intermediate cover sheet 142 to reveal and present the clean intermediate cover sheet 142 (which now becomes the top cover sheet 138) for continued use in painting.

During the paint work, the user may flip the paint shield 300 over to use either side of the construction tool covering accessory 100. Alternatively, once all the cover sheets in the first stack of removable cover sheets 112 on the first side 316 of the paint shield 300 have been used up, the painter simply has to turn over the paint shield 300 and continue painting with the second stack of removable cover sheets 114 on the second side 318 of the paint shield 300 protecting the paint shield 300 against any dripping paint. Thus, the double-sided construction tool covering accessory 100 not only protects the entire paint shield 300, including the first and second sides 316 and 318 and the leading edge 310, against paint build up but also allows the painter to continue painting uninterrupted without fear of stopping to add a new shield while trying to continue painting new paint over already drying paint.

Once the painting process has been completed, the construction tool covering accessory 100 may be removed from the paint shield 300 and disposed of or kept for subsequent use. To facilitate removal, the end portions 127 and 129 of the first and second inner portions 126 and 128 of the backing member 110 may be non-adhesive, allowing the user to easily grasp the end portions 127 and 129 and peel off the backing member 110 from the paint shield 300. Once the backing member 100 has been removed, the paint shield 300 remains uncontaminated from dripping paint and can be put away without the time and mess of cleaning it.

Alternative embodiments are contemplated without departing from the scope of the present disclosure. For instance, in some embodiments, the width W of the first stack of removable cover sheets 112 may be different from the width W of the second stack of removable sheets 114. Alternatively or additionally, the intermediate portion 130 and gap 120 may be arranged offset of the center of the backing member 110.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A construction tool covering accessory for keeping a paint shield or other flat-shaped construction tool clean from paint and debris during painting or when performing other construction-related tasks, the construction tool covering accessory comprising:

a backing member comprising an inner side and an outer side opposed to the inner side, wherein the inner side comprises an adhesive material;

a first stack of removable cover sheets affixed to a first portion of the backing member and a second stack of removable cover sheets affixed to a second portion of the backing member, wherein each removable cover sheet comprises an inner side oriented towards the backing member and an outer side opposed to the inner side of said each removable cover sheet; wherein the outer side of each removable cover sheet comprises an adhesive material, wherein the adhesive material of the outer side of each removable sheet is configured to detachably adhere to an adjacent cover sheet arranged over and outward of said each removable cover sheet and to remain on said outer side of said each removable cover sheet when the adjacent cover sheet is peeled off, and is further configured to detachably adhere to a wall or other surface when said each removable cover sheet is arranged in an outermost position; and further wherein the backing member is foldable to a folded position in which the first and second stacks of removable cover sheets are arranged oppositely to one another, and further in which the first and second portions of the backing member are arranged facing one another and defining a slot therebetween, wherein the slot is configured to receive a flat-shaped construction tool.

2. The construction tool covering accessory of claim 1, wherein the backing member comprises an intermediate portion arranged between the first and second portions of the backing member, and further wherein the backing member is foldable along said intermediate portion.

3. The construction tool covering accessory of claim 1, wherein, in the folded position, a gap is defined between the first and second stacks of removable cover sheets, wherein the gap is arranged along an intermediate portion of the backing member extending between the first and second portions of the backing member.

4. The construction tool covering accessory of claim 3, wherein the intermediate portion is central to the backing member.

5. The construction tool covering accessory of claim 3, wherein the intermediate portion is configured to wrap around and protect a leading edge of the flat-shaped construction tool.

6. The construction tool covering accessory of claim 3, wherein the backing member is arrangeable in a planar, extended position in which the first and second stacks of removable cover sheets are adjacent to one another, said gap being formed only when the backing member is folded from the extended position to the folded position.

7. The construction tool covering accessory of claim 1, wherein the first and second stacks of removable cover sheets are adhered to the first and second portions of the backing member, respectively.

8. The construction tool covering accessory of claim 1, wherein each of the first and second stacks of removable cover sheets comprises an outer cover sheet, an inner cover sheet and a plurality of intermediate cover sheets stacked between the outer and inner cover sheets.

9. The construction tool covering accessory of claim 1, wherein the adhesive material comprised in the outer side of each removable cover sheet comprises a strip of adhesive material arranged at and along a top edge of each removable cover sheet.

10. The construction tool covering accessory of claim 1, wherein the outer side of the backing member comprises information and/or indicia, and at least one of the first and second stacks of removable cover sheets is at least partially see-through such that the information and/or indicia on the outer side of the backing member is visible through said at least one of the first and second stacks of removable cover sheets.

11. The construction tool covering accessory of claim 1, further comprising a peel-off layer removably attached to the adhesive material on the inner side of the backing member.

12. The construction tool covering accessory of claim 1, wherein the inner side of each removable cover sheet is non-adhesive.

13. The construction tool covering accessory of claim 1, wherein the inner side of each removable cover sheet is adhesive.

14. The construction tool covering accessory of claim 13, wherein the outer side of the backing member comprises a release coating configured to facilitate removal of an adjacent cover sheet of the stack of removable cover sheets.

15. The construction tool covering accessory of claim 13, wherein the outer side of each removable cover sheet comprises a release coating configured to facilitate removal of an adjacent cover sheet of the stack of removable cover sheets.

16. The construction tool covering accessory of claim 1, wherein an edge area between each removable cover sheet and the adjacent cover sheet is devoid of adhesive material to facilitate grasping said adjacent cover sheet to peel off said adjacent cover sheet from said each removable cover sheet.

17. A construction tool covering accessory for keeping a paint shield or other flat-shaped construction tool clean from paint and debris during painting or when performing other construction-related tasks, the construction tool covering accessory comprising:

a flexible backing member comprising an inner side and an outer side opposed to the inner side, wherein the inner side comprises an adhesive material;

a first stack of removable cover sheets affixed to the outer side of a first portion of the backing member, wherein each removable cover sheet of the first stack of removable cover sheets comprises an inner side oriented towards the backing member and an outer side opposed to the inner side of said each removable cover sheet; and a second stack of removable cover sheets affixed to the outer side of a second portion of the backing member, wherein each removable cover sheet of the second stack of removable cover sheets comprises an inner side oriented towards the backing member and an outer side opposed to the inner side of said each removable cover sheet; wherein the outer side of each removable cover sheet of the first and second stacks of removable cover sheets comprises an adhesive material, wherein the adhesive material of the outer side of each removable sheet is configured to detachably adhere to an adjacent cover sheet arranged over and outward of said each removable cover sheet and to remain on said outer side of said each removable cover sheet when the adjacent cover sheet is peeled off, and is further configured to detachably adhere to a wall or other surface when said each removable cover sheet is arranged in an outermost position; and further wherein the construction tool covering accessory is foldable to from a planar position to a folded position in which the backing member is folded and the first and second stacks of removable cover sheets are arranged oppositely to one another, and further in which the first and second portions of the backing member are arranged facing one another and defining a slot therebetween, wherein the slot is configured to receive a flat-shaped construction tool.

* * * * *